US005860756A

United States Patent [19]

Fabrisi

[11] Patent Number: 5,860,756

[45] Date of Patent: Jan. 19, 1999

[54] TOP-FILL/BOTTOM-FILL COSMETIC CARRIER FOR A LIPSTICK CONTAINER

[75] Inventor: Michael J. Fabrisi, Naugatuck, Conn.

[73] Assignee: Rexam Cosmetic Packaging, Inc., Torrington, Conn.

[21] Appl. No.: 753,322

[22] Filed: Nov. 22, 1996

[51] Int. Cl.[6] ..... A45D 40/06

[52] U.S. Cl. ..... 401/78; 401/73; 401/87

[58] Field of Search ..... 401/78, 87, 73, 401/63

[56] References Cited

U.S. PATENT DOCUMENTS

| | | | |
|---|---|---|---|
| Re. 27,022 | 1/1971 | Fuglsang-Madsen | 401/78 |
| 2,332,147 | 10/1943 | Holihan | 401/87 X |
| 2,838,169 | 6/1958 | Grau . | |
| 2,858,937 | 11/1958 | Hoffman | 401/78 |
| 3,083,822 | 4/1963 | Clark . | |
| 3,150,770 | 9/1964 | Seaver . | |
| 3,346,703 | 10/1967 | Swenson | 401/78 X |
| 3,380,795 | 4/1968 | Gruska . | |
| 3,453,056 | 7/1969 | Motsavage et al. . | |
| 3,913,595 | 10/1975 | Grisel | 401/78 X |
| 4,323,157 | 4/1982 | Idec . | |
| 4,702,399 | 10/1987 | Davis . | |
| 4,750,882 | 6/1988 | Bouix . | |
| 4,813,801 | 3/1989 | Cardia . | |
| 4,820,070 | 4/1989 | Spatz . | |
| 4,915,528 | 4/1990 | Seager . | |
| 5,277,508 | 1/1994 | Gueret . | |

FOREIGN PATENT DOCUMENTS

| | | |
|---|---|---|
| 3442094 | 5/1986 | Germany . |
| 308 817 | 6/1997 | Taiwan . |
| 2 026 983 | 2/1980 | United Kingdom . |

*Primary Examiner*—Steven A. Bratlie
*Attorney, Agent, or Firm*—Bell Seltzer; Intellectual Property Law Group of Alston & Bird LLP

[57] ABSTRACT

A cosmetic carrier for a cosmetic container is designed so that the carrier may be top-filled or bottom-filled. The cosmetic carrier includes a cosmetic receiving cup defined by sidewalls and a base. The base of the cosmetic carrier includes a plurality of displaceable members which may be displaced upward permitting the cosmetic carrier to be bottom-filled but wherein downward displacement of the members is limited to permit the cosmetic carrier to be top-filled. A stop associated with the base limits downward movement and a hinge line on the upper surface of the base permits upward displacement of the displaceable members of the base.

35 Claims, 2 Drawing Sheets

TOP-FILL/BOTTOM-FILL COSMETIC CARRIER FOR A LIPSTICK CONTAINER

FIELD OF THE INVENTION

The present invention is directed to a container, such as a lipstick container, having a cosmetic carrier which may be top-filled or bottom-filled with a cosmetic.

BACKGROUND OF THE INVENTION

Conventional lipstick containers include a cosmetic carrier, a tubular inner sleeve, a tubular outer sleeve and a decorative outermost sleeve. The cosmetic carrier supports the lipstick and is generally configured as a sleeve having radially extending lugs on opposing sides and is received within the inner sleeve. The inner sleeve defines longitudinally extending channels on opposing sides wherein the lugs of the cosmetic carrier extend therethrough. A spiral sleeve defining a continuous helical channel is positioned about the intermediate sleeve wherein the lugs of the cosmetic carrier are configured to be received in and to traverse along the length of the helical channel. This results in the cosmetic carrier being moved upwardly as the lugs traverse the length of the helical channel when a bottom portion of the intermediate sleeve is rotated. A decorative outermost sleeve is often provided for aesthetic purposes. In operation, a bottom portion of the inner sleeve extends beyond the bottom of the outer decorative sleeve. The user rotates the bottom portion to cause the cosmetic carrier and hence, the lipstick, to extend from the case for applying the lipstick and to retract into the case for storage.

Prior art cosmetic carriers are usually either top-fillable or bottom-fillable. According to conventional prior art methods of top-filling a cosmetic carrier, a pre-formed pomade is molded, cooled, and then manually or mechanically inserted into the cosmetic carrier, stopping on a solid base defining the bottom of the carrier. According to an exemplary prior art method of bottom-filling a cosmetic carrier, the cosmetic carrier does not include a bottom and is inverted and the liquid pomade is poured through the open end of the cosmetic carrier and is formed in a mold and solidified. Prior art methods thereby require that cosmetic companies have the capability to fill the cosmetic carriers from both the top and the bottom to facilitate customers varied requirements. This involves large inventories of cosmetic carriers which must be stored and specifically ordered by the customers. This also requires production changeovers resulting in inefficient use of production machinery. However, prior art attempts of providing a versatile cosmetic carrier require complicated cosmetic containers and do not provide an adequate solution to the aforementioned problem.

For example, U.S. Pat. No. 4,813,801 to Cardia is directed to a complicated case for lipstick including a cosmetic holder which may either be top-filled or bottom-filled. The cosmetic container includes a cap, an external body, an intermediate body, and a stick holder. The stick holder is a tubular sleeve having an upper open extremity and a lower open extremity. The cosmetic container can be bottom-filled by disconnecting the external body, turning the case upside down and pouring a melted product into the intermediate body and through the lower portion of the stick holder. The fluid cosmetic mass enters the lower portion of the stick holder and completely fills the closed hollow upper portion forming the mold for the cosmetic stick. The method of top-filling the stick holder according to the prior patent includes pouring the melted product from the top of the cosmetic container when the cap and the closing capsule are disconnected and the stick holder is in a retracted position within the cosmetic container. Once a certain level is attained in the intermediate body, the cosmetic container is turned upside down. Accordingly, the cosmetic mass falls from the lower portion of the holder through the opening and into the upper hollow closed recipient forming the mold for the cosmetic stick. The prior patent discloses a complicated structure wherein the cosmetic stick holder is open on its bottom edge and the cosmetic is not supported by a base. The stick holder according to that patent is dissimilar to the type of cosmetic carriers typically demanded.

SUMMARY OF THE INVENTION

It is therefore an object of the present invention to provide a lipstick container having a versatile cosmetic carrier which may be bottom-filled or top-filled.

It is another object of the present invention to provide a versatile cosmetic carrier which can be used in place of conventional carriers which are either top-fillable or bottom-fillable.

The present invention overcomes the drawbacks and shortcomings of the prior art by providing a cosmetic container having a cosmetic carrier which may be filled either from the top or the bottom. The cosmetic carrier includes a cup for receiving the cosmetic defined by sidewalls and a base. The base includes a plurality of displaceable members for supporting the cosmetic within the cosmetic carrier. The displaceable members are displaceable upward to permit the carrier to be bottom-filled by insertion of a product fill tube. The force of the inserted tube causes the displaceable members to be displaced permitting the product fill tube to penetrate the base of the cosmetic carrier. The cosmetic carrier may also be top-filled because the displaceable members of the cosmetic carrier's base are prevented from significant displacement downward.

The displaceable members, preferably, are in the form of triangular flaps which extend inward from the sidewalls of the cosmetic carrier and terminate short of the center thereof so as to define a vent. The vent permits air to escape when increased internal pressure results, such as when the cosmetic carrier is top-filled. The triangular flaps are defined by three edges, one of which constitutes a hinge line permitting the displaceable member to move, such as by pivoting, upward. The displaceable members include upper surfaces including the hinge lines and bottom surfaces associated with a stop for preventing downward displacement, such as pivotal displacement, of the displaceable members.

The various embodiments of the present invention differ generally in the arrangement of the hinge lines and the stop for preventing the downward displacement of the displaceable members. In one embodiment, the stop is defined by an undercut in the form of a channel on the bottom surface of each of the displaceable members. Thus, if pressure is applied from above, such as when the cosmetic carrier is top-filled, the sides of the channel will abut one another and limit downward movement of the platform. The hinge lines are defined substantially by areas of decreased thickness defining a channel along the upper surface of the displaceable members. According to an alternative embodiment, the stop includes a protrusion associated with the bottom surface of the displaceable members. Thus, when downward pressure is applied to the displaceable members of the base, the protrusion will cooperate with the sidewalls of the cosmetic carrier and prevent downward displacement of the displaceable members. The hinge lines according the second embodiment are defined by a bevel which circumferentially surrounds the base of the cosmetic carrier. According to either embodiment, and obvious variations thereof, a cosmetic carrier is provided which may be top-filled or bottom-filled.

BRIEF DESCRIPTION OF THE DRAWINGS

The foregoing and other objects, features, and advantages of the present invention will be made apparent from the following detailed description of the preferred embodiment of the invention and from the drawings, in which.

DETAILED DESCRIPTION OF THE PREFERRED EMBODIMENTS

Figure 1:
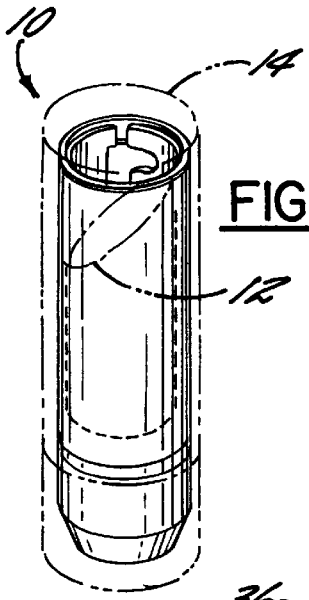
FIG. 1 is a perspective view of a cosmetic container according to the present invention.

The present invention will now be described more fully in detail with reference to the accompanying drawings, in which preferred embodiments of the invention are shown. This invention should not, however, be construed as limited to the embodiment set forth herein; rather, they are provided so that this disclosure will be thorough and complete and will fully convey the scope of the invention to those skilled in the art.

The present invention as shown and described herein is a container for applying cosmetics, such as lipstick. However, it should be evident that the container has utility in various other areas wherein a product is to be extended from and retracted into a case. For instance, the container may be utilized for any product requiring topical application.

The lipstick container of the present invention, indicated by the reference character 10, is designed for dispensing lipstick 12, shown in phantom, so that it may be cosmetically applied. An outer enclosure 14, shown in phantom, may be provided as a protective outer enclosure for the lipstick container 10. The lipstick container 10 includes a plurality of tubular members which are concentrically arranged about the longitudinal axis 30. The lipstick 12 is positioned within a cosmetic carrier 16 shown in the form of a cup to secure the lipstick therein. A plurality of longitudinally extending ribs 78 are formed along the inner surface of the cup of the cosmetic carrier 16 to secure the cosmetic 12 within the cosmetic carrier 16. The cosmetic carrier 16 includes a base 18 and, as shown, a cylindrical sidewall 20. Of course a cosmetic carrier 16 may be of any geometric form, and therefore, may have a plurality of sidewalls 20 (not shown). As illustrated, the sidewall 20 extends upwardly from the base 18 to define a cup 36 for receiving and holding the lipstick 12.

The cosmetic carrier 16 also includes a pair of lugs 22 positioned on diametrically opposing outer surfaces of the sidewall 20. Although the lugs 22, as shown, are provided as a pair and are diametrically opposed, it would not be a departure from the scope of the present invention to provide one or any number of lugs in any location along the outer surface of the cosmetic carrier 16.

Figure 2:
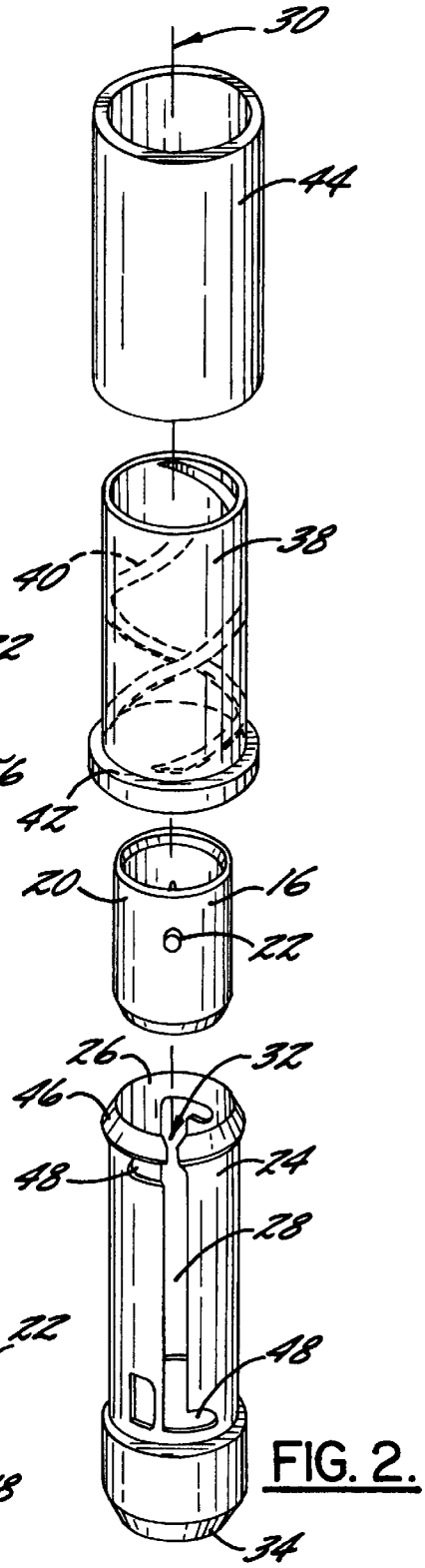
FIG. 2 is an exploded view of the cosmetic container of FIG. 1.

As best illustrated in FIG. 2, the cosmetic carrier 16 is positioned within a tubular inner sleeve 24. The tubular inner sleeve 24 includes, on opposing sidewalls, a pair of longitudinal slots 28 which extend parallel to the longitudinal axis 30 of the cosmetic container 10. Positioning of the cosmetic carrier 16 is enhanced by the integral opening 32 provided along the proximal end 26 of the longitudinal slot 28 of the tubular inner sleeve 24. Once positioned within the tubular inner sleeve 24, the cosmetic carrier 16 is movable longitudinally upwardly or downwardly within the inner sleeve 24. The longitudinal slots 28 permit the lugs 22 of the cosmetic carrier 16 to extend therethrough. At its distal end, the tubular inner sleeve 24 comprises a manually rotatable base 34.

A tubular intermediate sleeve 38 is positioned circumferentially around the tubular inner sleeve 24. The intermediate sleeve 38 includes a pair of opposed helical channels 40 formed on its inner surface. The helical channels 40 are defined by opposing upper and lower sidewalls and a bottom wall and are configured to receive at least a portion of the lug or lugs 22 as shown in the various figures. The intermediate sleeve 38 further includes a distal portion forming an outwardly extending flange 42.

A tubular outer sleeve 44 is positioned circumferentially around the intermediate sleeve 38 and the helical channel 40. The tubular outer sleeve 44, may be a decorative component. In an alternative embodiment, the intermediate sleeve 38 and the tubular outer sleeve 44 may be integrally formed wherein the tubular outer sleeve 44 may constitute the bottom wall of the helical channel 40 and the intermediate sleeve 38 includes a helical slot (not shown) defined by upper and lower sidewalls.

The above-described components of the lipstick container 10 permit easy application of the lipstick 12 by permitting the lipstick 12 to be extended and retracted within the lipstick container 10. The assembly, shown exploded in FIG. 2, is maintained in proper alignment and positioning due to the configuration of the various components. For instance, the proximal portion of the tubular inner sleeve 24 includes a thickened portion extending radially outward so as to form a flange 46. Similarly, the rotatable base 34 also forms a flange wherein the intermediate sleeve 38 and the tubular outer sleeve 44 are retained between the flange 46 and the rotatable base 34. The tubular outer sleeve 44 is properly positioned about the intermediate sleeve 38 due to the distal portion 42 of the intermediate sleeve 40 which, likewise, forms a thickened portion or flange.

The operation of the cosmetic container 10 according to the present invention will now be described with reference to the various figures. The cosmetic container extends and retracts the lipstick 12 to prevent extension thereof beyond the proximal end of the cosmetic container 10 so that it may be applied. The lipstick 12 is propelled within and from the cosmetic container 10 by removal of the outer enclosure 14 and by the rotation of the rotatable base 34 of the inner sleeve 24. Rotating the base 34 in a predetermined direction causes the cosmetic carrier 16 retained therein to likewise rotate due to the extension of the lugs 22 through the longitudinal slots 28 which would, inherently, abut a respective longitudinal side edge defining the longitudinal slot 28 (depending upon the direction of rotation). Because the lugs 22 are also received, or at least a portion thereof, within the helical channel 40, as the tubular rotatable inner sleeve 24 is rotated, the cosmetic carrier 16 traverses the length of the helical channels 40 of the intermediate sleeve 38 wherein it is moved upward or downward within the longitudinal slots 28.

At each of the distal and proximal ends of the longitudinal slot 30 are provided laterally extending locking extensions 48 which, as shown, are formed integrally with the longitudinal slots 28. The locking extensions 48 limit the upward movement of the cosmetic carrier 16 so that when the cosmetic carrier 16 reaches the uppermost position, it is restrained from further upward movement because further rotatable movement of the base 34 is prohibited. Likewise, when the lipstick 12 within the cosmetic carrier 16 is fully retracted, further retraction is limited due to the retention of the lug 22 within the lower laterally extending locking extension 48 of the longitudinal slot 28. Thus, the lipstick 12 may be extended by rotating the rotatable base 34 in one direction, and retracted by rotating the rotatable base 34 in the opposite direction to permit easy application while protecting the lipstick 12 within the cosmetic container 10 when not in use.

Figure 3:
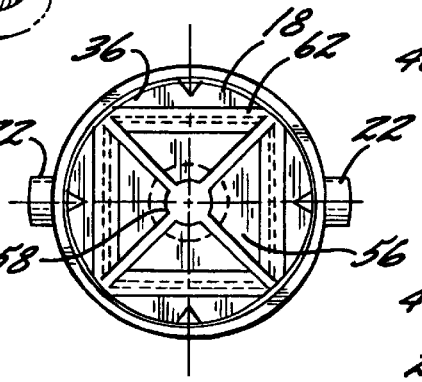
FIG. 3 is a top plan view of the cosmetic carrier according to a first embodiment of the present invention.
Figure 4:
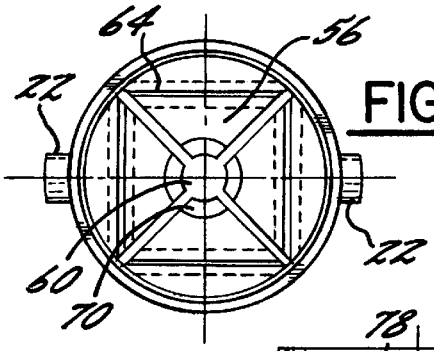
FIG. 4 is a bottom plan view thereof.
Figure 5:
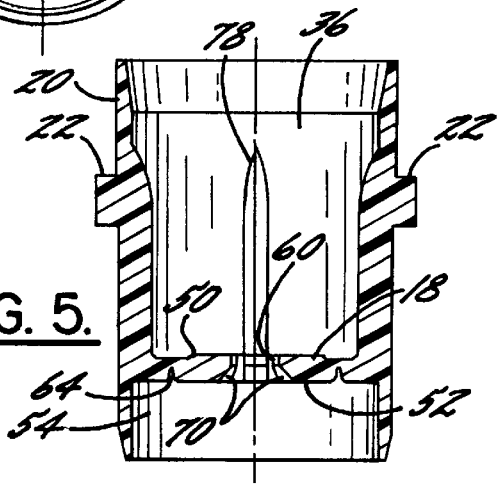
FIG. 5 is a cross-sectional view taken along the longitudinal axis thereof.

The first embodiment of the cosmetic carrier 16 according to the present invention is illustrated in FIGS. 3–5. As illustrated, the cosmetic carrier 16 includes a base 18 for supporting the lipstick 12 received within the cosmetic carrier 16. The sidewall 20 and an upper surface 50 of the base 18 define a cup 36 or cavity for receiving the lipstick 12. A portion of the sidewall 20 also extends below the base 18 as best seen in FIG. 5. Thus, the bottom side 52 of the base 18 and the sidewall 20 extending beneath the base 18 define a proximal portion 54.

The base 18 comprises at least one, and preferably a plurality, of displaceable members 56. As shown in FIG. 3, four radially positioned displaceable members 56 are illustrated. It is within the spirit and scope of the present invention to provide one or any number of displaceable members 56 wherein each of the members may be similarly configured or not. As best illustrated in FIGS. 3 and 4, the plurality of radially extending displaceable members 56 are in the form of flaps which extend inward from the base 18 and terminate at a terminal end 58. The terminal ends 58 define a vent 60 for venting pressure within the cosmetic container 10 when the cosmetic container is being assembled, such as when the cosmetic carrier 16 is top-filled as described below. In an alternative embodiment, not shown, the vent may be positioned anywhere within the cosmetic container rather than being centrally positioned upon the base 18 of the cosmetic carrier 16.

A hinge line 62 extends along the upper surface 50 of the base 18 of the cosmetic carrier 16. The hinge line 62 consists of a decreased thickness of the base 18 in the form of a channel, the thickness being defined by the distance between the upper surface 50 and the bottom surface 52 thereof. As illustrated in FIG. 3, the hinge line 62 extends along the upper surface 50 of the base 18 and along each of the flaps 56 in a substantially square configuration. However, it is within the spirit and scope of the present invention to provide any displacement facilitating means other than a hinge line. For example, a scored line may be utilized in place of a hinged line.

The bottom surface 52 of the base 18 is best illustrated in the bottom plan view of FIG. 4. As shown, the plurality of displaceable members 56 include a stop 64. According to the first embodiment of the present invention, the stop 64 is defined by an undercut or channel extending upwardly from the bottom surface 52 of the base 18. As shown in FIG. 4, a channel is provided which extends along each displaceable member 56 in a substantially square configuration to correspond with the configuration of the hinge lines 62 of the upper surfaces 50 of the displaceable members 56. Thus, the hinge lines 62 are preferably positioned above the respective stops 64.

As shown in FIG. 5, the stop 64 is in the form of an undercut or a channel 64 so that when downward axial force is applied to the base 18, such as when the lipstick is being inserted into the cosmetic carrier during a top-filling procedure, the sidewalls of the channel 64 will abut one another. This thereby limits or prevents the displaceable members from being displaced downward.

The cosmetic carrier 16 may accordingly be either top-filled or bottom-filled with the cosmetic. The plurality of displaceable members 62 and the base 18 provide a support for the lipstick 12 when it is positioned within the cosmetic carrier 16 because the displaceable members 56 are prevented from being significantly displaced downward due, at least in part, to the stops 64. If the cosmetic carrier is bottom-filled, however, the displaceable members 56 are permitted to be displaced upwards and, due to the hinge lines 62, such displacement is enhanced. Rather than providing hinge lines, the base 18 may include lines (not shown) which may be severed wherein the member 56 may break away from the base 18.

Figure 9:
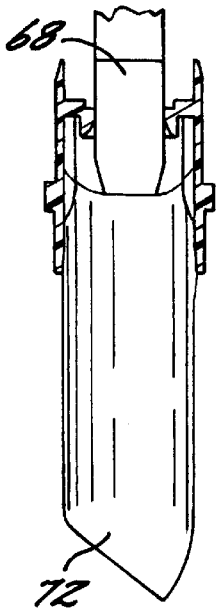
FIG. 9 depicts the cosmetic carrier according to either the first or second embodiment being bottom filled.

FIG. 9 illustrates the cosmetic carrier 16 being filled from the bottom. As shown in FIG. 9, the cosmetic carrier 16 is inverted and a product fill tube 68 penetrates the base 18 of the cosmetic carrier 16. Its insertion is facilitated by the chamfered or angled edges 70 of the terminal ends 58 of the displaceable members 56 as best illustrated in FIG. 5. Accordingly, when the product fill tube 68 penetrates the base 18, the displaceable members 62 pivot or are otherwise displaced upward such as by bending along the hinge lines 62. Thus, the cosmetic which is being dispensed by the product fill tube 68 may fill a mold 72 positioned in the cosmetic carrier 16. When the cosmetic solidifies, the mold 72 may be removed from the cosmetic carrier 16.

Figure 10:
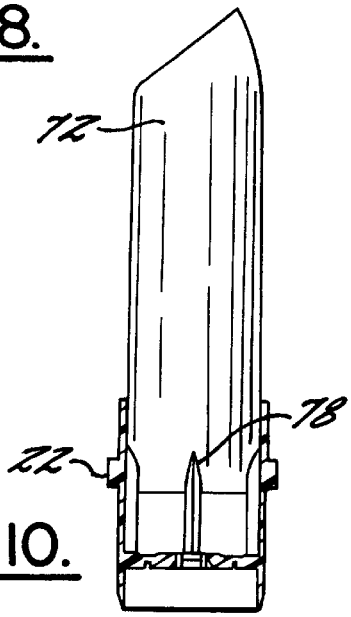
FIG. 10 depicts the cosmetic carrier according to either the first or second embodiment being top-filled.

The displaceable members 56 are also prevented, or at least limited, from being displaced downward, thereby enabling the cosmetic carrier 16 to be top-filled. As shown in FIG. 10, the cosmetic may be inserted into the cosmetic carrier either in a mold which may be removed or as a fabricated form wherein the cosmetic has already solidified. Downward movement of the displaceable members 56 is limited due to the stops 64. Accordingly, the base 18 provides a support for the inserted lipstick 12 and, together with the sidewall 20, defines the cavity 36 for receiving the lipstick 12. The central vent 60 permits the air to escape from the lipstick receiving cavity or cup 36 defined by the sidewall 20 and the base 18.

Figure 6:
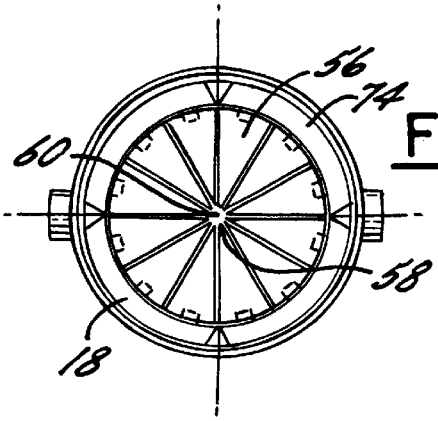
FIG. 6 is a top-plan view of a cosmetic carrier according to the second embodiment of the present invention.
Figure 7:
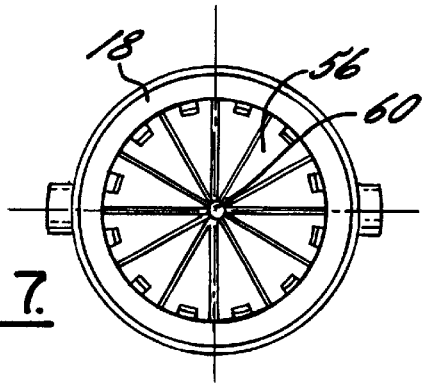
FIG. 7 is a bottom plan view thereof.
Figure 8:
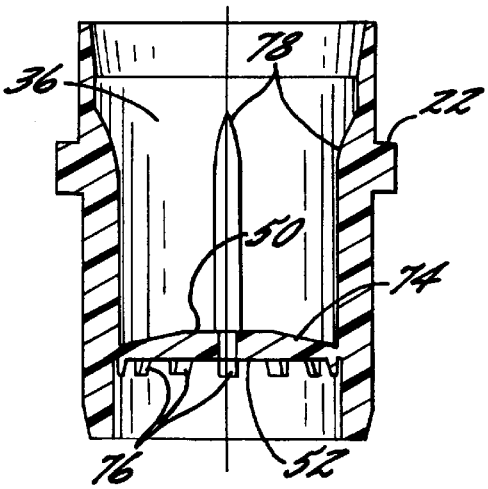
FIG. 8 is a cross-sectional view taken along the longitudinal axis thereof.

An alternative embodiment of a cosmetic carrier is illustrated in FIGS. 6–8. According to this second embodiment of the present invention, the base 18 includes also a plurality of displaceable members 56. As shown, twelve displaceable members 56 are illustrated, but it is within the scope of the present invention to provide one or any number thereof. The second embodiment is similar to the first embodiment with variations as to the stop 64 and the hinge lines 62 of the base 18. As shown, the upper surface 50 includes a hinge line 62 defined by, again, an area having a decreased thickness defined by the upper surface 50 and the bottom surface 52. The hinge line 62 is defined by an angled or bevelled portion 74 which extends circumferentially about the perimeter of the base 18.

The stop 64 is defined by a downward extending protrusion 76 which is positioned beneath the angled or weakened area 74 of the upper surface 50. The terminal ends of the protrusions 76 prevent downward movement of the displaceable members 56 by cooperating with the sidewall 20 of the cosmetic carrier 16 which extend beneath the base 18. Thus, when downward axial pressure is applied to the displaceable members 56, the protrusions 76 abut the sidewall 20 of the cosmetic carrier 16, thereby limiting or preventing downward motion. As in the other embodiment, the displaceable members 56 may be displaced upward, and in fact, such upward movement is enhanced due to the hinge line 62 defined by the angled portion 74. It would not be a departure from the present invention to provide a stop (not shown) integral with a sidewall of the cosmetic carrier 16 rather than formed integrally with the base 18. The stop need merely cooperate with the base 18 to permit the cosmetic carrier 16 to be top-filled or bottom-filled. The procedure for top-filling and bottom-filling the second embodiment is similar to that illustrated in FIGS. 9 and 10.

While particular embodiments of the invention have been described, it will be understood, of course, that the invention is not limited thereto since modifications may be made by those skilled in the area, particularly in light of the foregoing teachings. It is therefore contemplated by the appended claims to cover any such modifications that incorporate those features or these improvements in the true spirit and scope of the invention.

That which is claimed:

1. A cosmetic container comprising a tubular sleeve;

a helical channel extending along an inner periphery of said tubular sleeve;

a cosmetic carrier located within said tubular sleeve and having at least one radially outwardly extending lug having an end portion received in said helical channel;

said cosmetic carrier having a sidewall defining a cosmetic receiving compartment, an open upper end and a base for supporting the cosmetic within said cosmetic carrier, said base having at least one displaceable member which is displaced upward towards said open upper end to permit a cosmetic to be inserted through the base of said cosmetic carrier.

2. A cosmetic container according to claim 1 wherein said at least one displaceable member is a flap and said base comprises a plurality of said flaps mounted for movement along respective hinge lines.

3. A cosmetic container according to claim 2 further comprising a stop associated with each of said flaps.

4. A cosmetic container according to claim 2 wherein said flaps are triangular and are defined on one side by said hinge line and on two other sides by radially extending outward edges extending from a center of said base.

5. A cosmetic container according to claim 1 wherein said base comprises a vent for venting excess pressure resulting from assembly of said cosmetic container.

6. A cosmetic container according to claim 1 wherein said base further comprises an upper surface for contacting the cosmetic, a bottom surface, and at least one stop associated with said bottom surface for limiting downward movement of said at least one displaceable member.

7. A cosmetic container according to claim 6 wherein said stop is integral with the bottom surface of said base and said base includes a hinge line positioned above said stop.

8. A cosmetic container according to claim 7 wherein said hinge line is defined by an area having a decreased thickness between said upper and bottom surfaces of said base to enhance upward movement of said at least one displaceable member.

9. A cosmetic container according to claim 8 wherein said hinge line is defined by a channel extending substantially across the upper surface of said at least one displaceable member.

10. A cosmetic container according to claim 6 wherein said stop includes a channel extending along at least a portion of said bottom surface of said at least one displaceable member for limiting downward movement of said at least one displaceable member to permit said cosmetic carrier to be top-filled.

11. A cosmetic container according to claim 10 wherein said base includes a plurality of displaceable members, each including said channel which extends along said bottom surface of each of said plurality of displaceable members to form a substantially square configuration.

12. A cosmetic container according to claim 10 wherein said channel is positioned adjacent said sidewalls of said cosmetic carrier.

13. A cosmetic container according to claim 6 wherein said stop is defined by at least one projection extending from said bottom surface of said base and terminating at a terminal end, said terminal end being configured to limit downward movement of said at least one displaceable member to permit the cosmetic carrier to be top-filled with the cosmetic.

14. A cosmetic container according to claim 1 wherein said base comprises a plurality of radially extending displaceable members, each of said displaceable members extending inward from said sidewall and terminating at a terminal end, said terminal ends collectively defining a vent for venting pressures within said cosmetic container.

15. A cosmetic container according to claim 14 wherein said terminal ends of said displaceable members are angled to facilitate insertion of the cosmetic into said cosmetic carrier.

16. A cosmetic container according to claim 1, wherein said at least one lug comprises a pair of diametrically opposed lugs extending radially outwardly from opposite sides of said sidewall.

17. A cosmetic container comprising a first tubular sleeve;

a helical channel extending along an inner periphery of said tubular sleeve;

a tubular inner sleeve having a longitudinal slot extending parallel to the longitudinal axis thereof, said inner sleeve being rotatable within said first tubular sleeve;

a cosmetic carrier located within said first tubular sleeve and having at least one radially outwardly extending lug having an end portion extending through said longitudinal slot and being received in said helical channel of said tubular sleeve so that upon rotation of said inner sleeve, said cosmetic carrier is propelled longitudinally upwardly or downwardly within said tubular sleeve, said cosmetic carrier having sidewalls defining a cosmetic receiving compartment and defining an open upper end and a base for supporting the cosmetic within said carrier, said base having a plurality of radially extending displaceable members, each of said displaceable members extending inward from said sidewalls and terminating at a terminal end, and each of said members being displaceable upward towards said open upper end to permit the cosmetic to be inserted through the bottom of said base.

18. A cosmetic container according to claim 17 wherein said terminal ends define a vent for venting pressure within said cosmetic container.

19. A cosmetic container according to claim 17 further comprising a stop associated with each of said displaceable members for limiting downward movement of said displaceable members.

20. A cosmetic carrier for use in a cosmetic container, said cosmetic carrier comprising a sidewall and a base, said sidewall extending upwardly from said base to define a cup with an open upper end for receiving and holding a cosmetic, and at least one lug extending radially outwardly from said sidewall, said base having at least one displaceable member which may be displaced upward towards said open upper end to permit the cosmetic to be inserted into said cup through the base of said cosmetic carrier.

21. A cosmetic carrier according to claim 20 wherein said base further defines a vent for venting said cosmetic carrier during assembly thereof.

22. A cosmetic carrier according to claim 20 wherein said base includes an upper surface for contacting the cosmetic, a bottom surface, and at least one stop associated with said bottom surface for limiting downward movement of said at least one displaceable member.

23. A cosmetic carrier according to claim 22 wherein said stop is positioned on the bottom surface of said base and said upper surface of said base includes a hinge line positioned above said stop.

24. A cosmetic carrier according to claim 23 wherein said hinge line is defined by an area having a decreased thickness between said upper and bottom surfaces of said base to enhance upward movement of said at least one displaceable member.

25. A cosmetic carrier according to claim 24 wherein said stop is defined by at least one projection extending from said bottom surface of said base and terminating at a terminal end configured to limit downward movement of said at least one displaceable member to permit the cosmetic carrier to be top-filled with the cosmetic.

26. A cosmetic carrier according to claim 25 wherein said projection is arranged to cooperate with said sidewall of said cosmetic carrier.

27. A cosmetic carrier according to claim 24 wherein said hinge line is defined by a channel extending substantially across the upper surface of said at least one displaceable member.

28. A cosmetic carrier according to claim 22 wherein said stop includes a channel extending along at least a portion of said bottom surface of said displaceable member for limiting downward pivotal movement of said displaceable member to permit said cosmetic carrier to be top-filled.

29. A cosmetic carrier according to claim 28 wherein said channel extends along said bottom surface of said displaceable member in a square configuration.

30. A cosmetic carrier according to claim 20 wherein said base comprises a plurality of radially arranged displaceable members wherein each of said displaceable members extends inward from said sidewalls and terminates at a terminal end wherein said terminal ends define a vent for venting pressures within said cosmetic container.

31. A cosmetic carrier according to claim 30 wherein said terminal ends of said pivotable members are angled to facilitate insertion of the cosmetic into said cosmetic carrier.

32. A cosmetic carrier according to claim 30 wherein said pivotable members are triangular flaps defined on one side by a hinge line and with two adjacent sides extending radially from a center of said base.

33. A cosmetic carrier according to claim 20, wherein said at least one lug comprises a pair of diametrically opposed lugs extending radially outwardly from opposite sides of said sidewall.

34. A cosmetic carrier according to claim 20 wherein said cup includes at least one rib extending along an inner surface said sidewall for receiving a cosmetic and securing the cosmetic within said cosmetic carrier.

35. A cosmetic carrier according to claim 20 wherein said at least one displaceable member is a flap and said base comprises a plurality of said flaps mounted thereto along respective hinge lines.

* * * * *

UNITED STATES PATENT AND TRADEMARK OFFICE
CERTIFICATE OF CORRECTION

PATENT NO. : 5,860,756

DATED : January 19, 1999

INVENTOR(S) : Fabrisi

It is certified that error appears in the above-identified patent and that said Letters Patent is hereby corrected as shown below:

On the title page, Item [56],
In the References Cited, U.S. PATENT DOCUMENTS, line 7, "3,346,703" should read --3,346,103--.

Signed and Sealed this

Eighth Day of June, 1999

*Attest:*

Q. TODD DICKINSON

*Attesting Officer*

*Acting Commissioner of Patents and Trademarks*